US005829421A

United States Patent [19]

McLeod

[11] Patent Number: 5,829,421

[45] Date of Patent: Nov. 3, 1998

[54] DISCHARGE IGNITION APPARATUS FOR INTERNAL COMBUSTION ENGINE HAVING SHUT-OFF FEATURE

[75] Inventor: Paul W. McLeod, Warrenville, S.C.

[73] Assignee: R. E. Phelon Co., Inc., Aiken, S.C.

[21] Appl. No.: 883,943

[22] Filed: Jun. 27, 1997

[51] Int. Cl.[6] ..... F02F 1/00

[52] U.S. Cl. ..... 123/599

[58] Field of Search ..... 123/599, 630, 123/335, 198 DC

[56] References Cited

U.S. PATENT DOCUMENTS

| | | | |
|---|---|---|---|
| 4,073,279 | 2/1978 | Fox . | |
| 4,193,385 | 3/1980 | Katsumata et al. . | |
| 4,233,950 | 11/1980 | Kroiski et al. | 123/630 |
| 4,236,494 | 12/1980 | Fairchild | 123/599 |
| 4,324,215 | 4/1982 | Sieja | 123/335 |
| 4,404,940 | 9/1983 | Sieja | 123/335 |
| 4,951,625 | 8/1990 | Okuda | 123/198 DC |
| 4,976,234 | 12/1990 | Okuda | 12/90 |
| 5,076,250 | 12/1991 | Sasaki et al. . | |
| 5,190,019 | 3/1993 | Harvey . | |

*Primary Examiner*—Raymond A. Nelli
*Attorney, Agent, or Firm*—Dority & Manning, P.A.

[57] ABSTRACT

An improved capacitive discharge ignition apparatus includes disable circuitry for permitting shut-off of the engine. The disable circuitry is operative to gate the discharge SCR, thereby shorting current that would otherwise charge the storage capacitor. A portion of the charging current is diverted through a transistor to the SCR gate. The transistor is rendered conductive for a predetermined time by a RC circuit connected to its base. The RC circuit is charged by momentary contact of a user-actuated switch. The time constant of the RC circuit is preferably selected to achieve engine stoppage under any anticipated operating conditions.

26 Claims, 5 Drawing Sheets

DISCHARGE IGNITION APPARATUS FOR INTERNAL COMBUSTION ENGINE HAVING SHUT-OFF FEATURE

BACKGROUND OF THE INVENTION

The present invention generally relates to an improved ignition system for use in an internal combustion engine. More particularly, the invention relates to a discharge ignition apparatus configured to permit engine shut off.

It is often desirable to provide a "kill switch" to disable the ignition of a small gasoline engine. In many designs, an ignition switch is provided that remains in either an "On" position or "Off" position until changed by the user. Thus, the user is required to ensure that the switch is in the "On" position before the engine can be restarted.

In other designs, a momentary contact switch is provided to disable operation of the engine. In this case, the user will typically depress the "kill switch" while the engine is running. Even if the contact switch is subsequently released, holding circuitry may be provided to continue the ignition disable until the engine comes to rest. An example of this type of system is described in U.S. Pat. No. 4,193,385 to Katsumata, incorporated herein by reference.

The present invention is directed to novel ignition arrangements including a shut off feature.

SUMMARY OF THE INVENTION

In one aspect, the present invention provides an ignition apparatus for use with an internal combustion engine to produce an electrical spark at a spark ignition device. The apparatus comprises a magnet assembly, including a pair of pole faces, operatively revolved along a circular path. A magnetically permeable core is mounted adjacent to the circular path and has at least two leg portions each including a respective end face. The leg portions are situated such that the pole faces pass proximate to the end faces during revolution of the magnet assembly. As a result, a magnetic flux is produced in the magnetically permeable core.

The ignition apparatus further includes a transformer having a primary coil and a secondary coil related by a predetermined step-up ratio. The secondary coil is electrically connected during operation to the spark ignition device. Spark generation circuitry is also provided for applying a primary voltage pulse to the primary coil responsive to a triggering signal. The primary voltage pulse in turn produces a spark generating pulse in the secondary coil.

The ignition apparatus also includes disable circuitry operative to inhibit the spark generating pulse by providing a bypass through an electronic switching element upon actuation of a user-actuated switch. The disable circuitry is operative to continue the bypass even if the user-actuated switch is released. Toward this end, timing circuitry of the disable circuitry includes a selectively conducting element electrically connected to control the electronic switching element.

In some exemplary embodiments, the timing circuitry comprise a capacitive element connected to be charged upon actuation of the user-actuated switch. For example, the timing circuitry may preferably comprise a RC circuit having a predetermined time constant. In addition, the selectively conducting element may comprise a transistor having the RC circuit electrically connected to a base thereof.

Often, the electronic switching device will comprise a SCR device. In such cases, the transistor may be electrically connected to provide a gating current to the SCR device. In addition, it may be desirable to provide a resistive element electrically connected between the transistor and the SCR gate.

In some exemplary embodiments, the SCR device is electrically connected to comprise a component of the spark generation circuitry when the disable circuitry is not operative. Often, the spark generation circuitry will be electrically connected to derive the triggering signal from voltage induced across the primary coil. The triggering signal derived in this manner is applied to the SCR gate.

Another aspect of the present invention involves a discharge circuit for use in a discharge ignition system of the type operative to produce an electrical spark at a spark ignition device. The discharge circuit comprises a storage capacitor, a charge coil and a rectifier electrically connected therebetween. A transformer is also provided, including a primary coil and a secondary coil. The secondary coil is electrically connected during operation to the spark ignition device to produce the electrical spark.

Triggering circuitry is also provided, connected in circuit with the storage capacitor and the primary coil. The triggering circuitry is operative to discharge the storage capacitor through the primary coil at a predetermined time.

The discharge circuit further includes disable circuitry operative to provide a bypass through an electronic switch to prevent substantial charging of the storage capacitor. The disable circuitry is further operative to provide a gating current path to divert a portion of the charging current to a gate of the electronic switch. Preferably, the disable circuitry provides the gating current path for a predetermined time upon actuation of a user-actuated switch.

In some exemplary embodiments, the disable circuitry preferably includes timing circuitry having a selectively conducting element electrically connected in the gating current path. For example, the timing circuitry may comprise a RC circuit having a predetermined time constant. In addition, the selectively conducting element may comprise a transistor having the RC circuit electrically connected to a base thereof. A resistive element may be electrically connected between the transistor and the gate of the electronic switch.

Often, the electronic switch will be electrically connected to comprise a component of the triggering circuitry when the disable circuitry is not operative. In such cases, the gate of the electronic switch is preferably electrically connected to receive a triggering signal for discharge of the storage capacitor as supplied by the triggering circuitry, and to receive the portion of the charging current as supplied by the disable circuitry. The triggering circuitry may be electrically connected to derive the triggering signal from voltage induced across the primary coil. In some embodiments, a diode may be electrically connected in series with the gate of the electronic switch.

In another aspect, the present invention provides a discharge ignition apparatus for use with an internal combustion engine to produce an electrical spark at a spark ignition device. The apparatus comprises a movable magnet assembly including a pair of pole faces. A magnetically permeable core is also provided, having at least two leg portions each including a respective end face. The magnetically permeable core is mounted such that the pole faces pass proximate to the end faces as the magnet assembly is operatively moved to produce a magnetic flux in the magnetically permeable core. A transformer of the discharge ignition apparatus includes a primary coil, and a secondary coil electrically connected during operation to the spark ignition device.

The discharge ignition apparatus also includes a discharge circuit having an energy storage element and a charge coil. A charging voltage is induced on the charge coil by the magnetic flux to supply charging energy to the energy storage element. An electronic switch is electrically connected in circuit with the energy storage element and the primary coil. Activation of the electronic switch during operation by triggering circuitry produces a voltage on the primary coil.

The discharge circuit also includes disable circuitry electrically connected to the electronic switch and operative to provide a gating signal thereto upon actuation of a user-actuated switch. The disable circuitry includes timing circuitry to continue the gating signal for a predetermined time upon actuation of the user-actuated switch even if the user-actuated switch is released.

In some exemplary embodiments, the timing circuitry is electrically connected to provide a gating current path to divert a portion of a charging current to a gate of the electronic switch. The disable circuitry may include a selectively conducting element, such as a transistor, electrically connected in the gating current path. In such embodiments, the timing circuitry may include a RC circuit electrically connected to the selectively conducting element.

Other objects, features and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings, in which.

Figure 1:
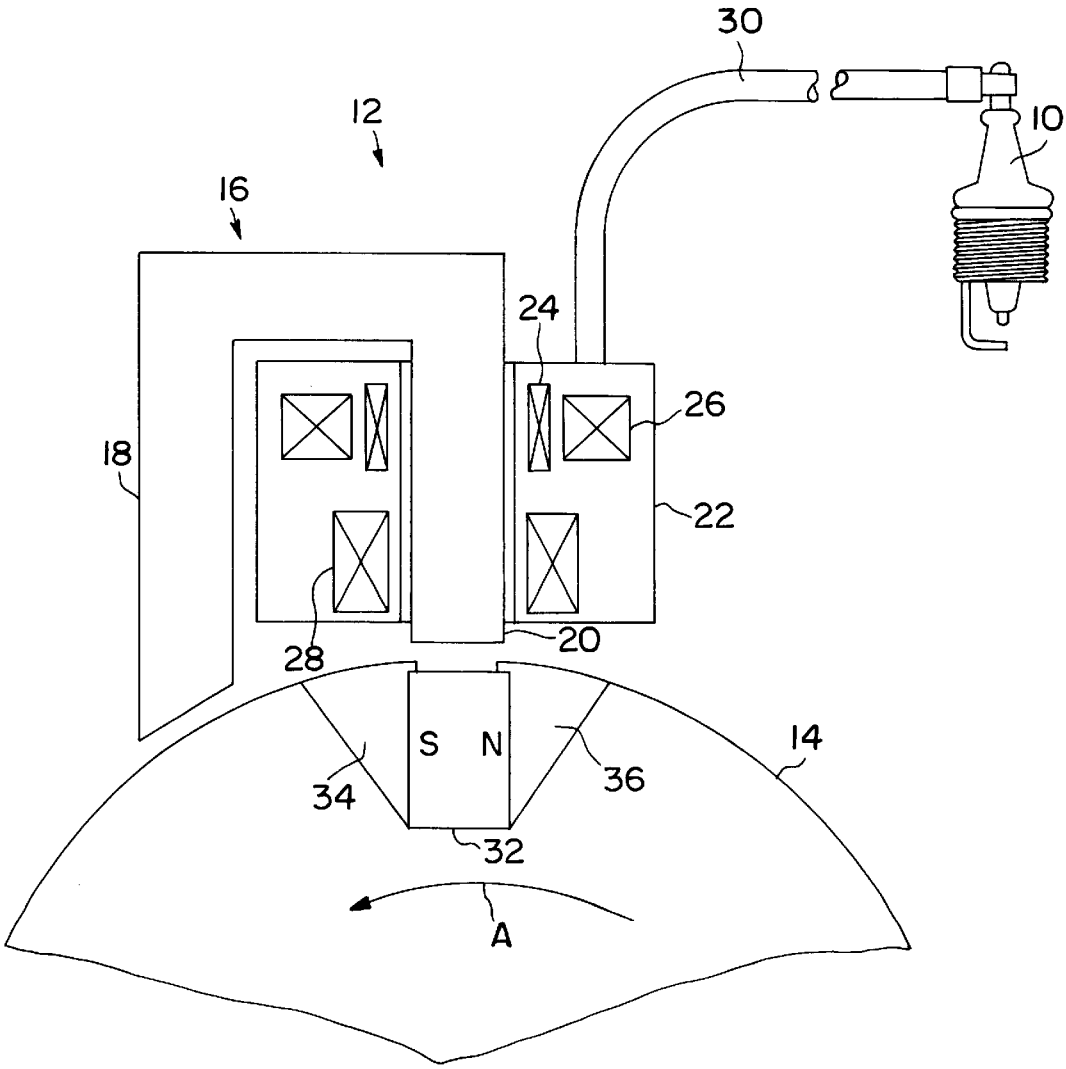
FIG. 1 is an elevational view of various components in a discharge ignition system such as may be constructed according to the present invention.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only and is not intended as limiting the broader aspects of the present invention, which broader aspects are embodied in the exemplary constructions.

FIG. 1 illustrates a discharge ignition apparatus constructed in accordance with the present invention. The apparatus is configured to produce the requisite spark at spark plug 10 to ignite the air-fuel mixture within the piston cylinder of the engine. The apparatus may be used with various devices powered by gasoline engines, particularly smaller two-cycle gasoline engines.

Generally, the apparatus includes a stator unit 12 and a rotatable flywheel 14. Flywheel 14 typically includes a central bore for mounting to a rotatable spindle mechanically interconnected with the engine's drive shaft. As a result, rotation of the spindle will produce a concomitant rotation of flywheel 14 (such as in the direction indicated by arrow A).

Stator unit 12, which typically remains fixed with respect to the engine during use, includes a magnetically permeable core 16. In this case, core 16 includes two depending leg portions, respectively indicated at 18 and 20. In many embodiments, however, the magnetically permeable core may be constructed having more than two such leg portions.

A sealed housing 22 maintains the various coils and other components utilized to produce a spark at spark plug 10. In particular, housing 22 includes a transformer having a primary coil 24 and a secondary coil 26. In the illustrated embodiment, coils 24 and 26 may be mounted coaxially about leg portion 20. A charge coil 28, which may also be mounted about leg portion 20, provides a source of energy for the ignition spark as will be explained more fully below. The various components within housing 22 may be protected and maintained securely in position via a suitable potting compound. Electrical connection with spark plug 10 is achieved by a typical interconnecting wire 30.

A magnet assembly is mounted adjacent the periphery of flywheel 14 to revolve about a circular path in synchronism with operation of the engine. The magnet assembly includes a permanent magnet 32 having pole pieces 34 and 36 mounted at respective ends thereof. It will be appreciated that the circumferential faces of pole pieces 34 and 36 will pass proximate to the end faces of leg portions 18 and 20 as flywheel 14 is rotated. As a result, magnetic flux is produced within core 16, as desired.

Figure 2:
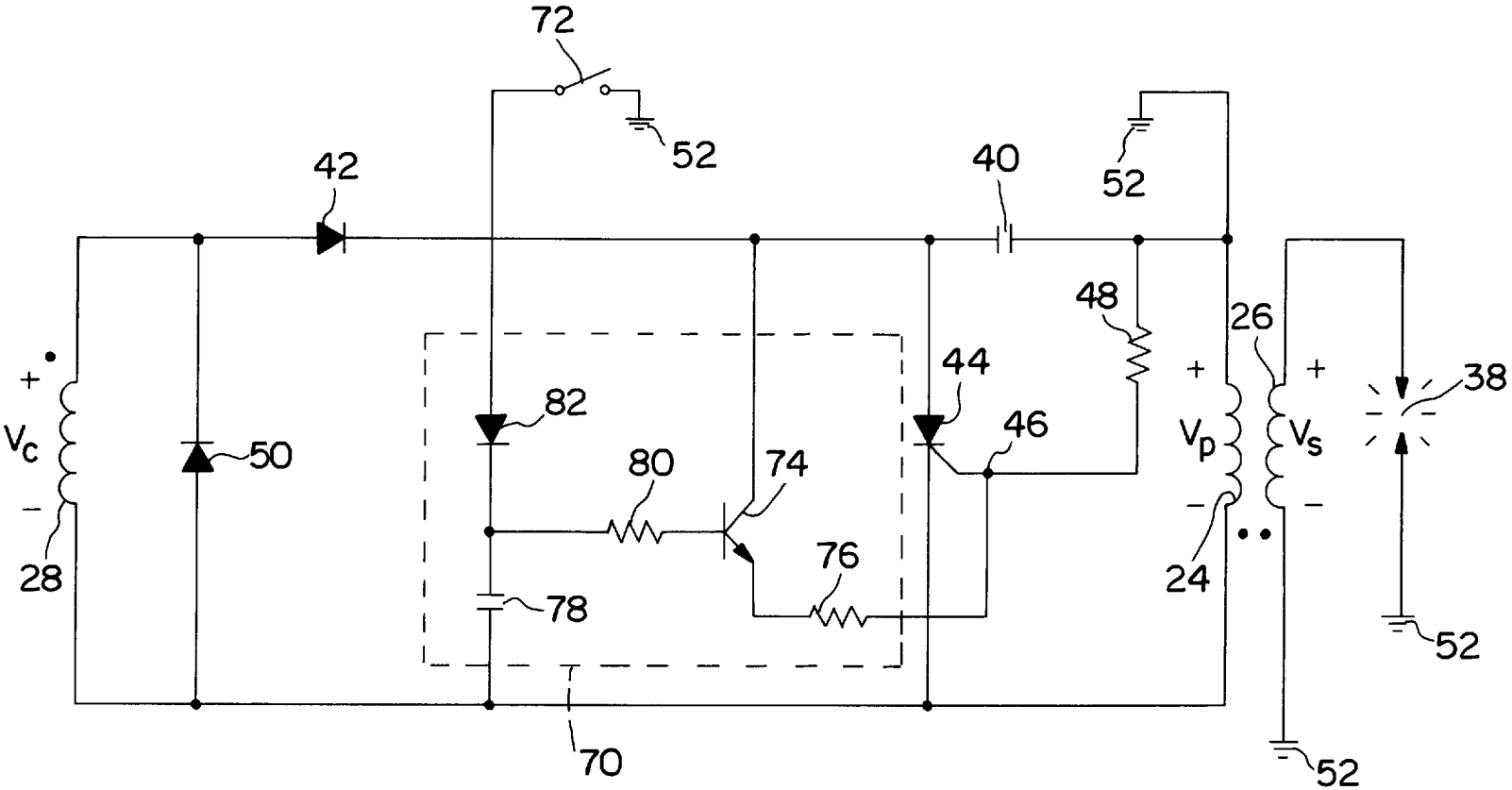
FIG. 2 is a schematic diagram illustrating an exemplary electronic ignition circuit constructed according to the present invention.

The various electronic components contained within sealed housing 22 of stator unit 12 may be most easily understood with reference to the schematic circuit diagram of FIG. 2. As can be seen, secondary coil 26 is connected across the gap 38 of spark plug 10. Charge coil 28 is electrically connected to a storage capacitor 40 through a rectifier diode 42. Capacitor 40 is, in turn, electrically connected in circuit with primary coil 24 through SCR 44.

SCR 44 is rendered conductive by a triggering signal supplied to triggering node 46, which is the SCR gate. Preferably, the triggering signal may be derived from the voltage induced across primary coil 24. For example, one terminal of primary coil 24 may be connected to the SCR gate through a single current limiting resistor 48. In other cases, the triggering signal may be produced by a voltage divider network across primary coil 24 to ensure that the triggering signal occurs at a particularly desired point on the primary coil voltage curve.

Diode 50 functions as a ringback diode for reversal of the polarity of capacitor 40 during discharge. A relative ground, as indicated at 52, typically provides electrical communication with the engine block.

The operation of the circuit shown in FIG. 2 will now be explained with reference to the waveforms illustrated in FIGS. 3A through 3C. The illustrated waveforms are merely diagrammatic in nature for which scale is not implied. In addition, one skilled in the art will recognize that references to "positive" or "negative" are merely a matter of convention. It will also be appreciated that the illustrated sequence is repeated for every revolution of the magnet assembly.

Figures 3A, 3B, 3C:
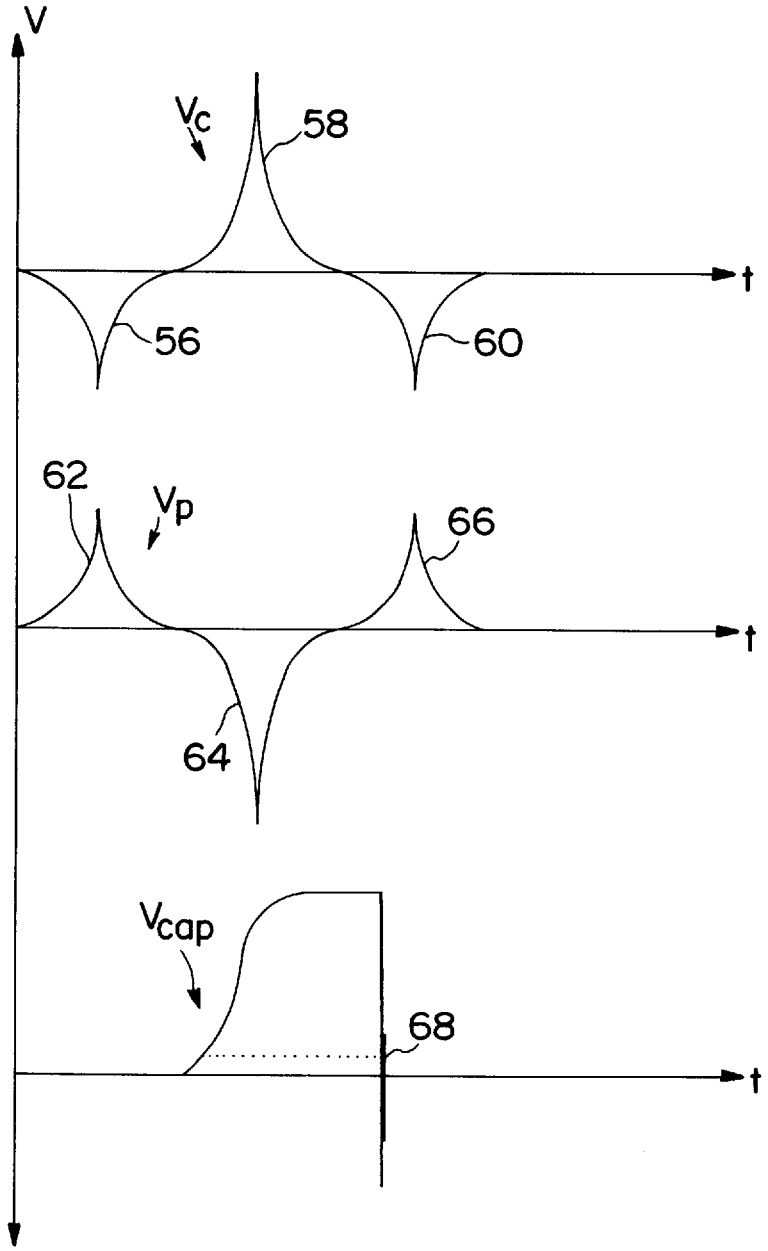
FIGS. 3A through 3C diagrammatically illustrate various voltage plots taken at respective locations in the circuit of FIG. 2.

FIG. 3A illustrates a waveform $V_c$ of the voltage produced across charge coil 28 during one passage of the magnet assembly carried by flywheel 14. As can be seen, waveform $V_c$ includes a first negative excursion 56 followed by a relatively large positive excursion 58. Typically, capacitor 40 will be charged during positive excursion 58, and assume a value near the peak voltage reached during the excursion. A second negative excursion 60 follows positive excursion 58.

FIG. 3B illustrates a waveform $V_p$ such as may be induced across primary coil 24 at corresponding points in time. The voltage waveform induced across secondary coil 26 will have a similar shape, although the magnitude will be larger due to the greater number of turns at this winding. As can be seen, waveform $V_p$ exhibits a positive excursion 62 followed by a negative excursion 64. Negative excursion 64 is then followed by a positive excursion 66.

While positive excursion 62 applies a triggering signal to the gate of SCR 44, capacitor 40 has not yet been charged. At the beginning of positive excursion 66, however, capacitor 40 has been charged and is ready to discharge through primary coil 24. This can be seen in FIG. 3C, where the voltage $V_{cap}$ builds up before discharging when the triggering signal is applied. The voltage across capacitor 40 oscillates during discharge as indicated at 68.

As shown in FIG. 2, the ignition apparatus further includes disable circuitry (collectively indicated at 70) for permitting a user to shut-off the engine when desired. In particular, disable circuitry 70 provides, responsive to actuation of switch 72, a bypass for current that would otherwise charge capacitor 40. Since capacitor 40 will not be substantially charged, a spark-producing voltage will not be generated across secondary coil 26. Preferably, switch 72 may be a contact switch urged into a normally open state such as by an appropriate spring bias mechanism.

In the illustrated embodiment, the charging current is substantially bypassed through SCR 44 before reaching capacitor 40. SCR 44 is gated for disabling purposes by current conducted through transistor 74. A resistor 76 is provided in series with transistor 74 for the purpose of limiting transistor leakage currents, induced by large collector-emitter voltages applied, to some value below the gating threshold of SCR 44.

The base of transistor 74 is connected to a RC network including capacitor 78 and resistor 80. Disable circuitry 70 further includes a diode 82 connected between one terminal of switch 72 and capacitor 78. As shown, the other terminal of switch 72 is connected to ground 52.

Figure 2B:
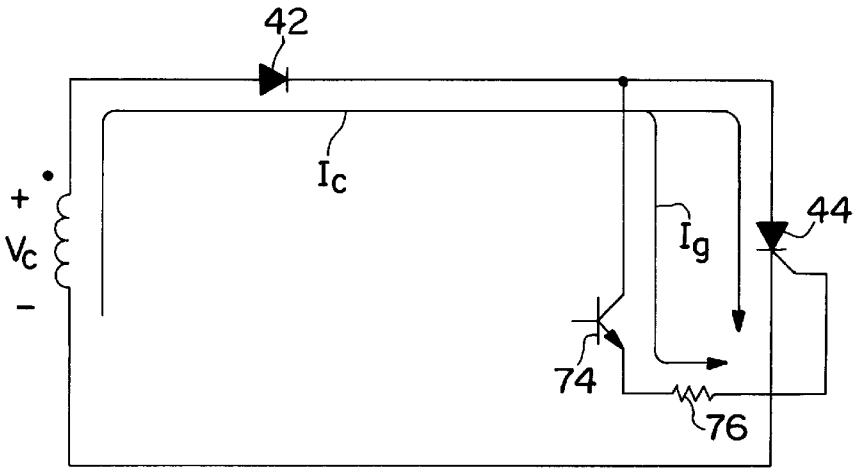
FIGS. 2A and 2B are partial schematics illustrating aspects of the engine shut-off feature in the circuit of FIG. 2.
Figure 2A:
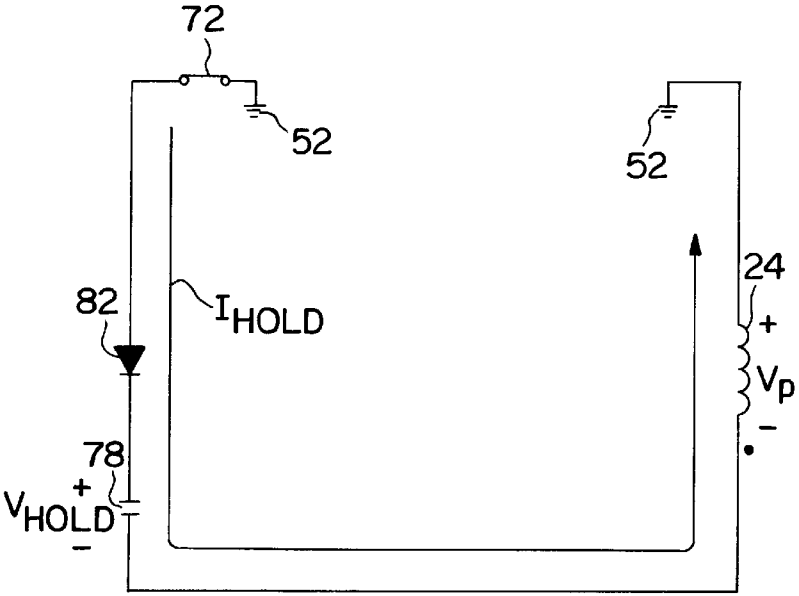

Referring now also to FIG. 2A, engine shut-off is initiated when a user momentarily closes switch 72. As a result, capacitor 78 is quickly charged through diode 82 by virtue of the current $I_{HOLD}$ produced from the voltage $V_p$ induced on primary coil 24. The voltage $V_{HOLD}$ thus accumulated on capacitor 78 is applied to the base of transistor 74 through resistor 80. It will be appreciated that the amount of time that transistor 74 remains conductive will be dependent on the time constant of the RC network. The time constant is preferably chosen to achieve complete engine shut-off regardless of variables such as engine load or inertia.

As shown in FIG. 2B, a portion $I_g$ of the charging current $I_c$ is diverted through transistor 74 and resistor 76 to the gate of SCR 44. SCR 44 thus remains "on," causing the remaining charging current to bypass capacitor 40. While a single SCR is advantageously utilized in the illustrated embodiment, one skilled in the art will recognize that separate SCR devices could be employed for spark generation and disable bypass purposes.

Transistor 74 multiplies the current applied to its base from the RC network to a level sufficient to gate SCR 44. This allows the required time constant to be achieved with a much smaller capacitance than would otherwise be the case. For example, a capacitor value of less than 10 $\mu$F, preferably less than 5 $\mu$F, may be appropriate in many embodiments of the invention. Without transistor 74, several orders of magnitude greater capacitance would be required to supply sufficient gating current to achieve shut-off. When the engine comes to rest, capacitor 78 fully discharges and the circuit is reset. Thus, the operator need not reset a switch before restarting the engine.

Figure 4:
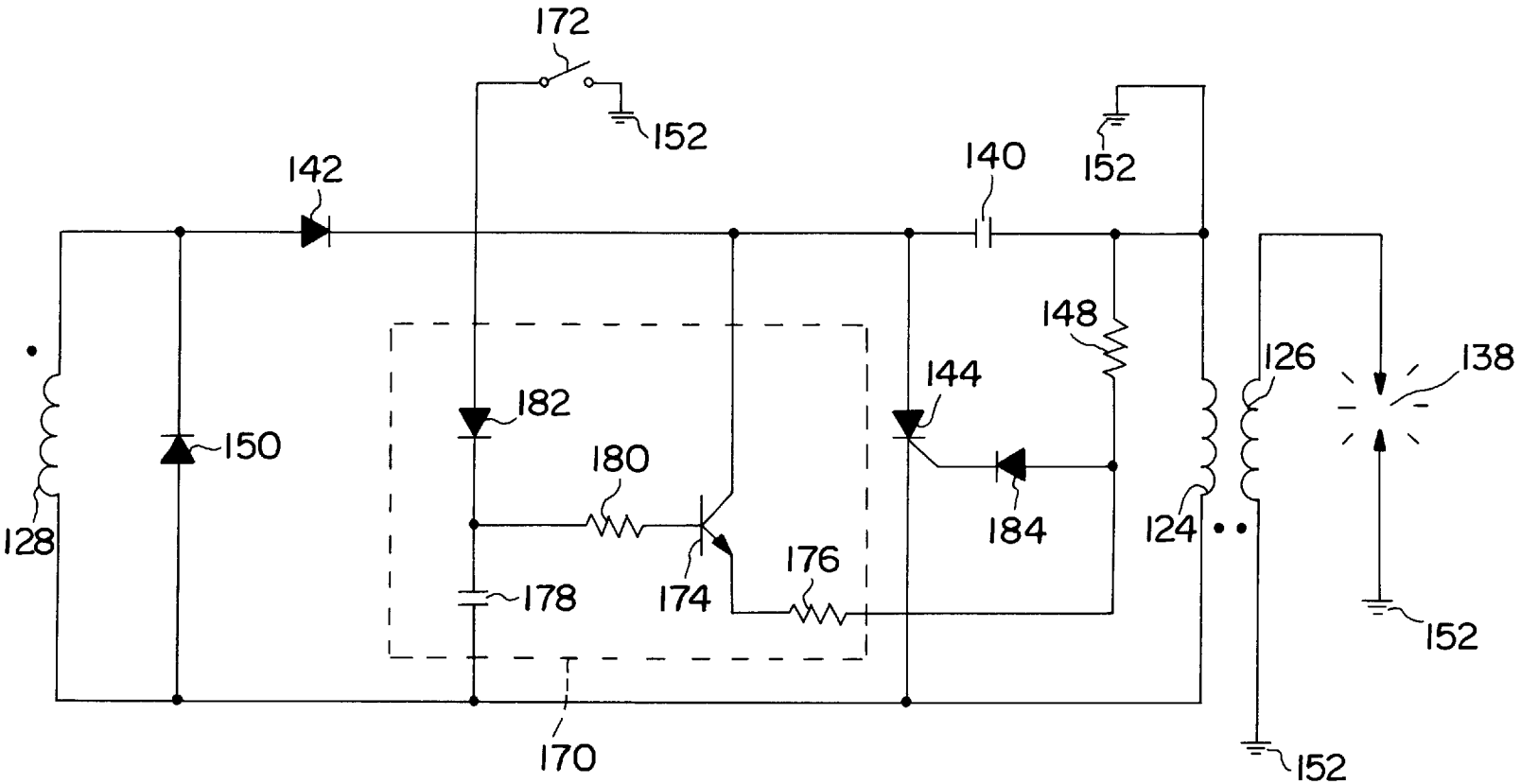
FIG. 4 is a schematic diagram of an alternative electronic ignition circuit constructed according to the present invention.

FIG. 4 illustrates an alternative circuit arrangement that operates in a manner similar to the circuit of FIG. 2 in many important respects. As such, analogous components in the FIG. 4 circuit have reference numbers augmented by one-hundred in relation to their counterparts in FIG. 2. It can be seen, however, that a diode 184 has been added at the gate of SCR 144. One skilled in the art will understand operation of the FIG. 4 circuit without a detailed explanation.

While preferred embodiments of the invention have been shown and described, modifications and variations be made thereto by those of ordinary skill in the art without departing from the spirit and scope of the present invention. For example, it may be desirable in some circuit arrangements to substitute an inductor or other circuit component as the energy storage element. In addition, it should be understood that aspects of various embodiments of the invention may be interchanged both in whole or in part. Furthermore, those of ordinary skill in the art will appreciate that the foregoing description is by way of example only, and is not intended to be limitative of the invention so further described in the appended claims.

What is claimed is:

1. An ignition apparatus for use with an internal combustion engine to produce an electrical spark at a spark ignition device, said apparatus comprising:

a magnet assembly operatively revolved along a circular path, said magnet assembly including a pair of pole faces;

a magnetically permeable core mounted adjacent to said circular path and having at least two leg portions each including a respective end face, said leg portions being situated such that said pole faces pass proximate to said end faces during revolution of said magnet assembly and produce a magnetic flux in said magnetically permeable core;

a transformer having a primary coil and a secondary coil related by a predetermined step-up ratio, said secondary coil electrically connected during operation to the spark ignition device;

spark generation circuitry operative to apply a primary voltage pulse to said primary coil responsive to a triggering signal, said primary voltage pulse producing a spark generating pulse in said secondary coil; and disable circuitry operative to inhibit said spark generating pulse by providing a bypass through an electronic switching element upon actuation of a user-actuated switch and operative to continue said bypass even if said user-actuated switch is released, said disable circuitry including timing circuitry having a selectively conducting element electrically connected to control said electronic switching element.

2. An ignition apparatus as set forth in claim 1, wherein said timing circuitry comprises a capacitive element connected to be charged upon actuation of said user-actuated switch.

3. An ignition apparatus as set forth in claim 2, wherein said timing circuitry comprises a RC circuit having a predetermined time constant.

4. An ignition apparatus as set forth in claim 3, wherein said selectively conducting element comprises a transistor, said RC circuit being electrically connected to a base of said transistor.

5. An ignition apparatus as set forth in claim 4, wherein said electronic switching element comprises a SCR device, said transistor electrically connected to provide a gating current to said SCR device.

6. An ignition apparatus as set forth in claim 5, further comprising a resistive element electrically connected between said transistor and a gate of said SCR device.

7. An ignition apparatus as set forth in claim 1, wherein said selectively conducting element comprises a transistor biased for conduction for a predetermined time upon actuation of said user-actuated switch.

8. An ignition apparatus as set forth in 1, wherein electronic switching element of said disable circuitry comprises a SCR device.

9. An ignition apparatus as set forth in claim 8, wherein said SCR device is electrically connected to comprise a component of said spark generation circuitry when said disable circuitry is not operative.

10. An ignition apparatus as set forth in claim 9, wherein said spark generation circuitry is electrically connected to derive said triggering signal from voltage induced across said primary coil and to apply said triggering signal to a gate of said SCR device.

11. A discharge circuit for use in a discharge ignition system of the type operative to produce an electrical spark at a spark ignition device, said discharge circuit comprising:

(a) a storage capacitor;

(b) a charge coil;

(c) a rectifier electrically connected between said charge coil and said storage capacitor;

(d) a transformer including a primary coil and a secondary coil, said secondary coil electrically connected during operation to the spark ignition device to produce the electrical spark;

(e) triggering circuitry electrically connected in circuit with said storage capacitor and said primary coil and operative to discharge said storage capacitor through said primary coil at a predetermined time; and (f) disable circuitry operative to provide a bypass through an electronic switch thereof to prevent substantial charging of said storage capacitor, said disable circuitry further operative to provide a gating current path to divert a portion of a charging current to a gate of said electronic switch.

12. A discharge circuit as set forth in claim 11, wherein said disable circuitry provides said gating current path for a predetermined time upon actuation of a user-actuated switch.

13. A discharge circuit as set forth in claim 11, wherein said disable circuitry includes timing circuitry having a selectively conducting element electrically connected in said gating current path.

14. A discharge circuit as set forth in claim 13, wherein said timing circuitry comprises a RC circuit having a predetermined time constant.

15. A discharge circuit as set forth in claim 14, wherein said selectively conducting element comprises a transistor, said RC circuit being electrically connected to a base of said transistor.

16. A discharge circuit as set forth in claim 15, wherein said electronic switch comprises a SCR device.

17. A discharge circuit as set forth in claim 16, further comprising a resistive element electrically connected between said transistor and said gate of said SCR device.

18. A discharge circuit as set forth in claim 11, wherein said electronic switch is electrically connected to comprise a component of said triggering circuitry when said disable circuitry is not operative.

19. A discharge circuit as set forth in claim 18, wherein said gate of said electronic switch is electrically connected to receive a triggering signal for discharge of said storage capacitor as supplied by said triggering circuitry and to receive said portion of said charging current as supplied by said disable circuitry.

20. A discharge circuit as set forth in claim 19, wherein said triggering circuitry is electrically connected to derive said triggering signal from voltage induced across said primary coil and to apply said triggering signal to said gate of said electronic switch.

21. A discharge circuit as set forth in claim 20, further comprising a diode electrically connected in series with said gate of said electronic switch.

22. A discharge ignition apparatus for use with an internal combustion engine to produce an electrical spark at a spark ignition device, said apparatus comprising:

a movable magnet assembly, said magnet assembly including a pair of pole faces;

a magnetically permeable core having at least two leg portions each including a respective end face, said magnetically permeable core being mounted such that said pole faces pass proximate to said end faces as said magnet assembly is operatively moved to produce a magnetic flux in said magnetically permeable core;

a transformer having a primary coil and a secondary coil, said secondary coil electrically connected during operation to the spark ignition device; and a discharge circuit including:

(a) an energy storage element;

(b) a charge coil having a charging voltage induced thereon by said magnetic flux to supply charging energy to said energy storage element;

(c) an electronic switch electrically connected in circuit with said energy storage element and said primary coil, activation of said electronic switch during operation producing a voltage on said primary coil;

(d) triggering circuitry operative to activate said electronic switch to produce said voltage on said primary coil; and (e) disable circuitry electrically connected to said electronic switch and operative to provide a gating signal thereto upon actuation of a user-actuated switch, said disable circuitry including timing circuitry to continue said gating signal for a predetermined time even if said user-actuated switch is released.

23. A discharge ignition apparatus as set forth in claim 22, wherein said timing circuitry is electrically connected to provide a gating current path to divert a portion of a charging current to a gate of said electronic switch.

24. A discharge ignition apparatus as set forth in claim 23, wherein said disable circuitry includes a selectively conducting element electrically connected in said gating current path.

25. A discharge ignition apparatus as set forth in claim 24, wherein said selectively conducting element comprises a transistor.

26. A discharge ignition apparatus as set forth in claim 24, wherein said timing circuitry includes a RC circuit electrically connected to said selectively conducting element.

* * * * *